US005152216A

United States Patent [19]

Bourgeois

[11] Patent Number: 5,152,216

[45] Date of Patent: Oct. 6, 1992

[54] APPARATUS FOR DATE-STAMPING AN INTERIOR SURFACE OF A CONTAINER

[76] Inventor: Leonard Bourgeois, 341 St. Marc, Chateauguay, Quebec, Canada, J6J2K2

[21] Appl. No.: 527,935

[22] Filed: May 24, 1990

[51] Int. Cl.[5] ..... B41F 17/00

[52] U.S. Cl. ..... 101/35; 101/4; 101/41; 101/368; 101/405

[58] Field of Search ..... 101/4, 9, 35, 41, 405, 101/379, 368, 333; 118/DIG. 10, DIG. 3; 427/230

[56] References Cited

U.S. PATENT DOCUMENTS

| | | | |
|---|---|---|---|
| 1,590,905 | 6/1926 | Rettmer | 101/4 |
| 2,382,804 | 8/1945 | Morrison | 101/41 |
| 2,620,731 | 12/1952 | Slonneger | 101/405 |
| 2,664,820 | 1/1954 | Brown | 101/405 |
| 2,778,306 | 1/1957 | Harris | 101/333 |
| 2,963,961 | 12/1960 | Sundstrom | 101/4 |
| 3,045,593 | 7/1962 | Petterson | 101/368 |
| 3,333,536 | 8/1967 | Messersmith | 101/333 |
| 3,703,142 | 11/1972 | Mimlitch | 101/368 |
| 3,948,173 | 4/1976 | Barasch | 101/333 |
| 4,077,319 | 3/1978 | Edminsten | 101/41 |
| 4,401,030 | 8/1983 | Connolly et al. | 101/41 |

*Primary Examiner*—Edgar S. Burr
*Assistant Examiner*—Christopher A. Bennett
*Attorney, Agent, or Firm*—Jones, Tullar & Cooper

[57] ABSTRACT

An interior lower wall surface (S) of a container (C) can be marked in accordance with the present invention by insertion of a slidably mounted, elongated rod (14) having a marking device (88) arranged at a lower end (14) into the container (C) through an access opening (O) against which a handle (12) slidably supporting the rod (14) is abutted and giving a downward force to the elongated rod (14). When not in use, the printing apparatus (10) according to the invention can be kept in an inked and ready-to-use mode by insertion into a holder (20) provided with an inked-pad (106) containing receptacle (104).

9 Claims, 3 Drawing Sheets

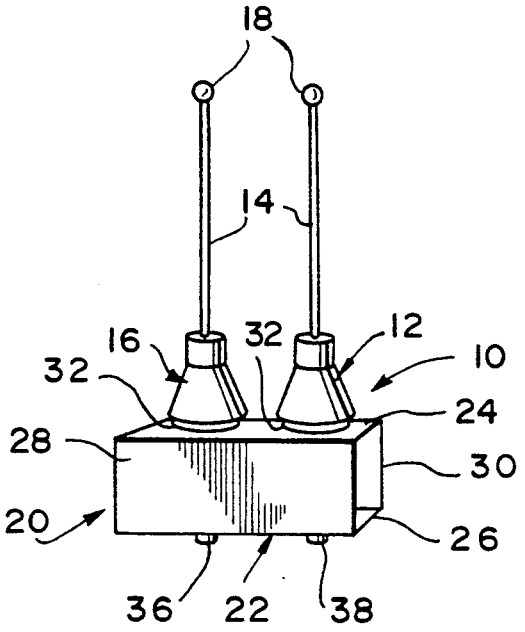
FIG. 1
FIG. 2
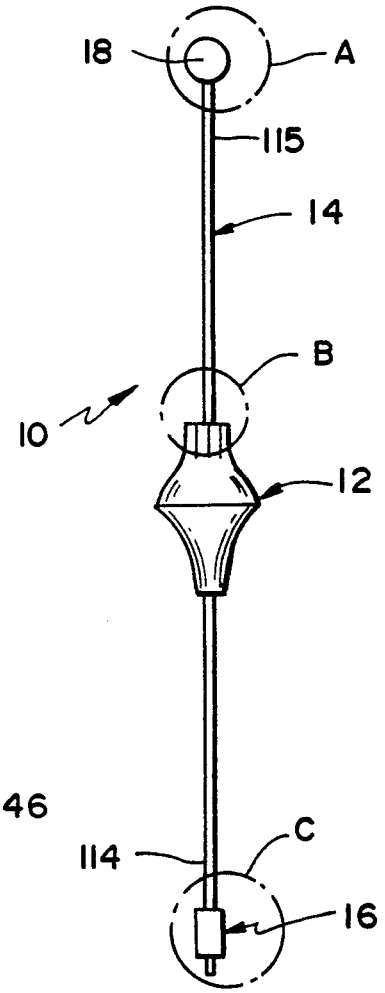
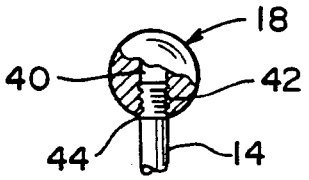
FIG. 3
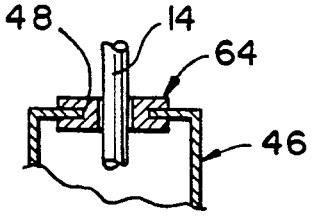
FIG. 4
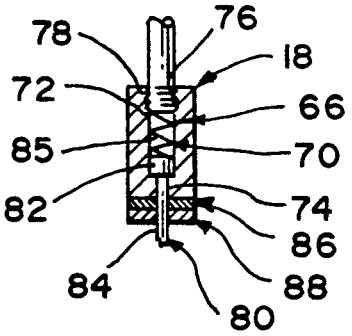
FIG. 5
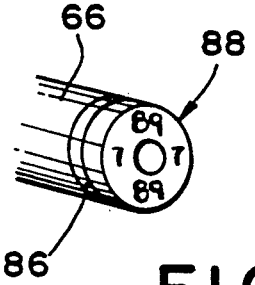
FIG. 6

APPARATUS FOR DATE-STAMPING AN INTERIOR SURFACE OF A CONTAINER

BACKGROUND OF THE INVENTION

1. Field of the Invention

This invention relates generally to the placement of indicia on an interior surface of a container, and more particularly to apparatus for date-stamping the bottom surface of a portable fire extinguisher and similar vessels.

2. Description of the Prior Art

The National Fire Protection Association (NFPA) has set forth standards for portable hand held fire extinguishers classified as stored pressure types, which category includes both dry chemical and halon portable fire extinguishers, that requires such fire extinguishers be emptied and subjected to applicable maintenance procedures every six years. The standards specify that internal service tags be attached to a siphon tube of an extinguisher inspected as certification of such inspection. This manner of certification has been criticized as not assuring that the fire extinguisher has in fact been emptied and properly maintained prior to placement of the service tag.

U.S. Pat. No. 2,963,961, issued Dec. 13, 1960 to J. F. Sundstrom discloses a method for date-stamping a soft plug provided in the bottom of a mold by inserting a punch provided with a marking element at a tip thereof into an entranceway of a mold to be stamped and causing the marking element to imprint the soft plug. A problem with this technique, however, is that a special container must be constructed provided with a soft plug in the bottom thereof, and with a special collar arranged around an entranceway into the vessel in order to receive the marking tool.

U.S. Pat. No. 4,667,594, issued May 26, 1987 to A. W. Addy discloses an imprinting apparatus in which an expansible block expands to print on interior side walls of a hollow article such as a tape-roll core. A problem with this technique, however, if applied to the marking of containers, is that imprints on an interior side wall of a vessel are not always visible to one looking into the vessel through an access opening provided in it.

U.S. Pat. No. 1,590,905, issued Jun. 29, 1926 to J. J. Rettmer, and U.S. Pat. No. 4,401,030, issued Aug. 30, 1983 to J. E. Connolly et al, disclose examples of portable marking tools using a reciprocating movement of a marking member in order to make a mark. These devices, however, are not suitable for use with standard containers such as fire extinguisher bottles.

U.S. Pat. Nos. 2,771,026, issued Nov. 20, 1956 to L. P. Mooney, 2,778,306, issued Jan. 22, 1957 to C. C. Harris, 3,333,536, issued Aug. 1, 1967 to W. P. Messersmith and 3,948,173, issued Apr. 6, 1976 to K. S. Barasch, disclose inking devices in which an inked pad is disposed in a cup-like receptacle so as to be engaged by a rubber or similar stamping element and be in an inked condition when needed to perform a printing operation.

SUMMARY OF THE INVENTION

It is an object of the present invention to provide apparatus suitable for certifying pressure-type portable fire extinguishers in a manner which requires the fire extinguisher to be emptied before a certification mark can be made.

It is another object of the present invention to provide apparatus for imprinting a bottom interior surface of a container without requiring modification of the container.

It is still another object of the present invention to provide a rack-like holder for marking apparatus according to the present invention which will maintain the marking apparatus in an accessible and operational mode at all times.

These and other objects are achieved according to the present invention by providing marking apparatus including a handle member selectively engagable with a portion of a conventional container, the interior bottom surface of which is to be marked, that defines an access opening into the interior of the container. Slidably mounted on the handle member is an elongated rod having a pair of longitudinally spaced ends and arrangable with one of the pair of ends extending into the interior of a container to be marked when the handle member is placed into engagement with the container at an access opening thereof. A marker assembly is mounted to the one of the pair of ends of the rod extending into the interior of the container to be marked for making a mark on an interior surface of the container opposed to the access opening thereof on a downward movement of the rod relative to the handle member.

Apparatus according to the present invention advantageously is stored in a holder comprising a housing including a hollow, rectangular framework including an upwardly facing wall and a downwardly facing wall. At least one, and preferably a plurality, of socket elements are disposed in an upwardly directed surface of the housing for retainingly receiving a handle member of an associated marking apparatus according to the present invention. Disposed extending from a downwardly facing wall of the housing, so as to extend away from the upwardly facing wall thereof, advantageously is provided an inker communicating with the interior of the housing for receiving a marker assembly of a marking apparatus according to the invention inserted into a socket element disposed in opposition to the inker so as to maintain the marker device in an inked condition at all times.

An advantage of the present invention is that a mark, such as indicia signifying a particular month, and year, can be imprinted on a surface of a container, such as a fire extinguisher bottle, without requiring modification of the container.

Another advantage of the present invention is that a mark can be made on an interior wall surface of a container opposite to an access opening thereof so as to permit the mark to be easily read from the access opening.

BRIEF DESCRIPTION OF THE DRAWINGS

FIG. 1 is a diagrammatic, perspective view showing a pair of marking apparatuses according to the present invention retained in a stored mode in a holding rack according to the present invention.

FIG. 2 is a diagrammatic, side elevational view showing a marking apparatus according to the present invention.

FIG. 3 is a diagrammatic, fragmentary, side elevational view, partially broken away and in section, showing in greater detail the portion of FIG. 2 enclosed within the circle designated by the reference letter A.

FIG. 4 is a diagrammatic, fragmentary, vertical sectional view, showing in greater detail the portion of FIG. 2 enclosed within the circle designated by the reference letter B.

FIG. 5 is a diagrammatic, fragmentary, vertical sectional view, showing in greater detail the portion of FIG. 2 enclosed within the circle designated by the letter C.

FIG. 6 is a fragmentary, perspective view, showing the lower area of the structure illustrated in FIG. 5.

DESCRIPTION OF THE PREFERRED EMBODIMENTS

Figure 7:
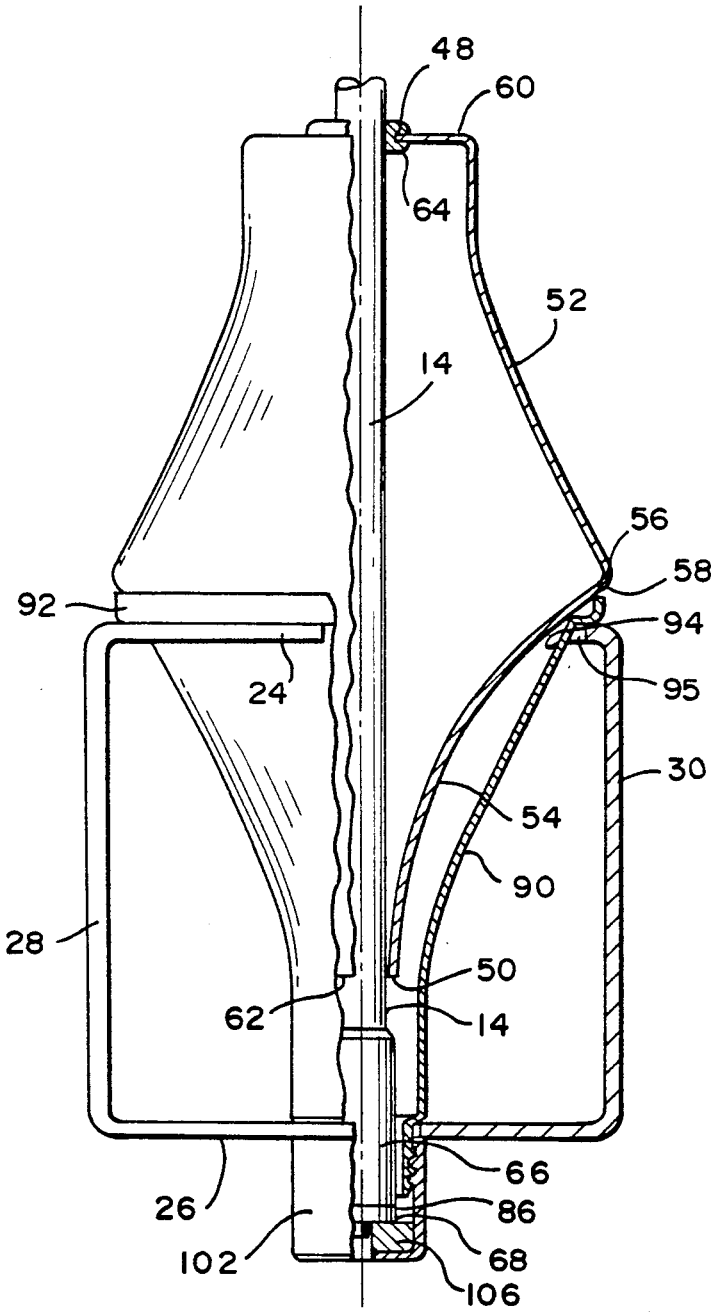
FIG. 7 is a fragmentary, end view of the apparatus of FIG. 1, drawn to a larger scale, showing the right half of one of the marking apparatuses in vertical section.

Referring now more particularly to FIGS. 1 and 2 of the drawings, apparatus 10 according to the present invention for marking a surface positioned in opposition to an access opening defined in a container comprises a handle member 12 arranged for selectively engaging a portion of a container to be marked so as to surround an access opening defined in the container. An elongated rod 14 having a pair of longitudinally spaced ends 114 and 115 is mounted on handle member 12 for sliding movement relative to member 12. End 114 of rod 14 is arrangable extending into a container to be marked when handle member 12 is selectively engaging a container, as seen in FIGS. 10*a–d* and to be described in detail below. Mounted on end 114 of rod 12 is a marker assembly 16 for marking a surface of a container on a movement of rod 14 relative to handle member 12 in a direction toward the surface to be marked. Mounted on end 115 of rod 14 is a knob 18 that facilitates performing the sliding motion.

A holder 20 according to the present invention is provided for retaining one or more of the marking apparatuses 10 in a stored, but ready-to-use condition whenever the particular apparatus 10 is not being used. Holder 20 is in the form of a rack including a housing 22 comprising a hollow, rectangular framework including an upwardly facing wall 24, a downwardly facing wall 26 substantially parallel to and coextensive with wall 24, and a pair of substantially parallel, coextensive side walls 28 and 30 connecting together walls 24 and 26 in a spaced relation. One or more socket elements, with two such elements 32 and 34 being shown, are provided in wall 24 of housing 22 for selectively, retainingly receiving the handle member 12 of an apparatus 10 according to the present invention. Provided in the bottom wall 26 of housing 22 is one or more inkers, with two inkers 36 and 38 being illustrated, arranged in opposition to sockets 32 and 34 for inkingly engaging the marker assembly 16 of an apparatus 10 when it is retainingly received in an associated socket element 32.

FIG. 3 shows in detail a preferred attachment of knob 18 to rod 14 as by the illustrated recess 40 provided with internal screw threads 42 threadingly engaging with external screw threads 44 provided on end 115 of rod 14.

As can be seen from FIGS. 4 and 7 of the drawings, handle member 12, which facilitates manipulation of apparatus 10, includes a hollow body 46 defining a pair of opposed holes 48 and 50 sized for slidably receiving rod 14. Hollow body 46 is illustrated as comprising two hollow sections 52 and 54 each in the shape of a conical frustum having a respective large base 56, 58 and a small base 60, 62. The sections 52, 54 are affixed to one another, and preferably are formed as one piece as by molding and the like, in overlying relation at the large bases 56, 58 thereof, and each small base 60, 62 of section 52, 54 is provided with a respective one of the opposed holes 48, 50 defined in hollow body 46 to permit passage of rod 14. Disposed in hole 48 is a rubber grommet 64 which acts as a slide guide for rod 14.

As can be seen from FIG. 5, together with FIG. 7, marker assembly 16 includes a block 66 mounted on end 114 of rod 14 and supporting in spaced relation to rod 14 an imprint subassembly 68 according to the present invention. A resilient assembly 70 is associated with block 66 for biasing same away from a surface to be marked.

Block 66 is provided with a blind bore 72 extending from rod 14, and with a through passage 74 communicating with bore 72 and also arranged for extending away from rod 14. Screw threads 76 formed on end 114 of rod 14, and complementary screw threads 78 formed in the blind bore 72 permit removable attachment of block 66 to rod 14. The resilient or pressure asserting assembly 70 includes a piston 80 comprising a head portion 82 slidably arranged in bore 72 and a shaft portion 84 slidably arranged in the passageway 74 and extending outwardly of the block 66. Pressure assembly 70 further comprises a conventional compression spring 85 arrangable in bore 72 between the end 114 of rod 14 and the head portion 82 of piston 80 for biasing piston 80 away from rod 14.

Retained on the portion of block 66 adjacent passageway 74 and shaft portion 84 of piston 80 as by a felt washer 86 and the like, in a conventional manner as by the use of a suitable, known adhesive, is a stamp device 88 best seen in FIG. 6. This device will be replaced periodically, such as monthly. While illustrated device 88 sets forth indicia designating a month and year, it is to be understood that any indicia can be provided on the stamp device 88 for imprinting such indicia on a surface of a container to be marked when rod 14 is moved against the bias of the resilient assembly 70.

Figure 8:
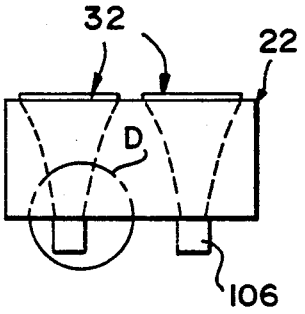
FIG. 8 is a diagrammatic, sided elevational view showing a marking apparatus holding rack according to the present invention.
Figure 9:
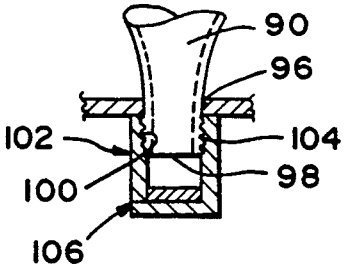
FIG. 9 is a diagrammatic, fragmentary, vertical sectional view, showing in greater detail the area enclosed within the circle designated by the reference letter D in FIG. 8.

Each socket element 32, 34, as seen from FIGS. 7–9 of the drawings, includes a frustoconical, hollow shroud 90 provided with a lip 92 at a large base area 94 thereof for being retainingly fitted into an opening 95 formed in an upwardly facing wall 24 of holder housing 22. A port 96 is provided in the downwardly facing wall 26 of housing 22, and an apex 98 forming a small base of shroud 90 extends through port 96 so as to display external screw threads 100 beyond the wall 24. Threadingly engaged with the threads 100 is a cup-shaped receptacle 102 provided with internal screw threads 104 so as to abut against the lower face of the wall 24 of housing 22. A conventional inked pad 106 is disposed in receptacle 102 for engagement by the stamping device 88, as can be seen from FIG. 7. That is, when apparatus 10 is inserted into a shroud 90 so as to rest on lip 92 at the waist of body member 46 formed by the large bases 56, 58, stamping device 88 will rest against inked pad 106, as seen in FIG. 7.

A manner of using an apparatus 10 according to the present invention will be discussed with reference to FIGS. 10A—10D of the drawings.

Figure 10D:
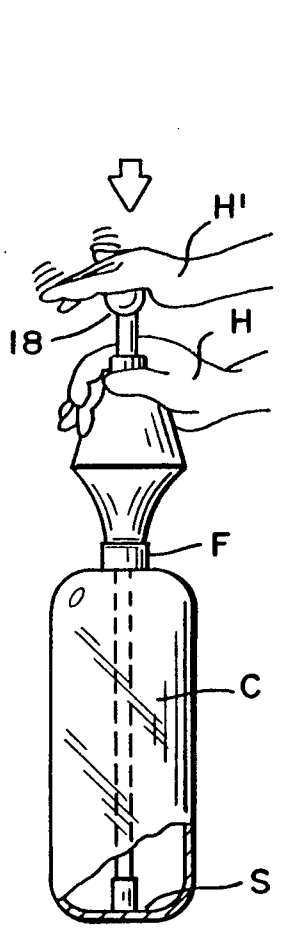
FIGS. 10A—10D illustrate diagrammatically the serious of steps involved in marking an interior bottom surface of a container with apparatus according to the present invention.
Figure 10C:
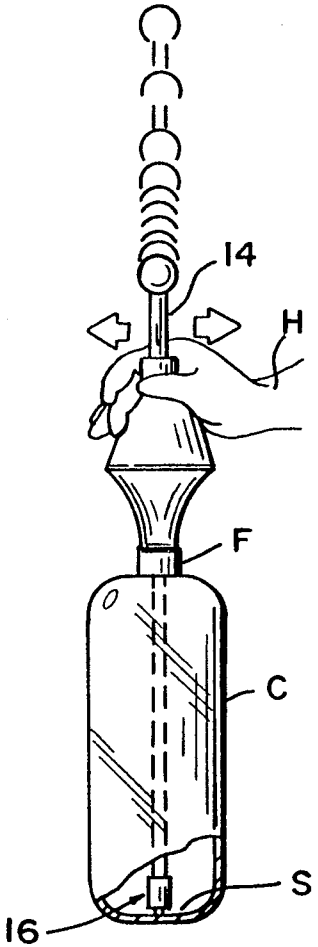
Figure 10B:
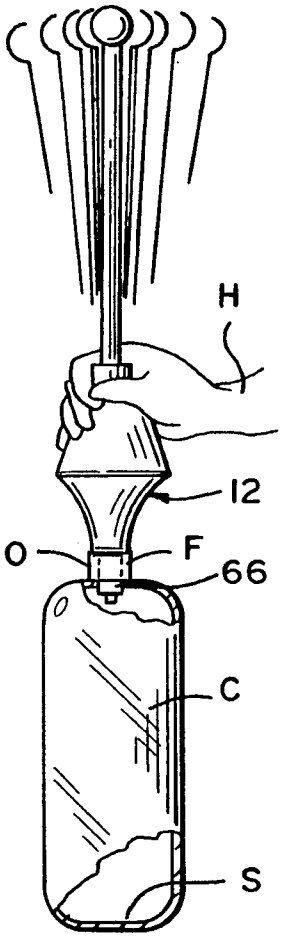
Figure 10A:
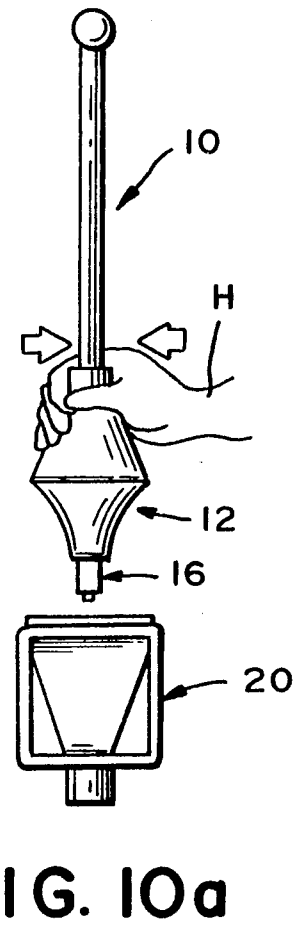

When a user needs an apparatus 10, it is removed from holder 20 as by grasping handle member 12 by a hand H in the manner illustrated in FIG. 10A. While continuing to hold apparatus 10 in such a manner, block 66 is inserted into an opening O formed by a flange F of a container C, such as a pressure-type fire extinguisher bottle, defining an interior lower surfaces S, as seen in FIG. 10B. Once apparatus 10 is in place, rod 14 can be induced to slide downwardly relative to handle member 12 as by shacking and the like, as illustrated in FIGS. 10B and 10C, so as to assume the position shown in FIG. 10C with marker assembly 16 adjacent surfaces to be marked. Once apparatus 10 has assumed the position shown in FIG. 10C, hand H can be maintained in place to steady the apparatus 10, while the user's other hand H' can be used to force knob 18 downwardly so as to overcome the bias of the resilient assembly 70 and cause a mark to be impressed on lower surface as of container C as seen in FIG. 10D.

As can be readily understood from the above description in from the drawings, a marking apparatus 10 according to present invention permits an interior surface of a container to be marked in a simple and efficient manner, leaving an imprint readily observable from an access opening to the container, and without requiring modification of any kind to the container being marked.

I claim:

1. Apparatus for marking a surface positioned in opposition to an access opening defined in a container, comprising, in combination:

(a) handle means for selectively engaging a portion of a container to be marked that surrounds an access opening defined in the container;

(b) elongated rod means having a pair of longitudinally spaced ends and mounted on the handle means for sliding movement relative thereto, the rod means having a one of the ends thereof arrangable extending through an access opening of and into a container to be marked when the handle means is selectively engaging a container to be marked; and (c) marker means mounted on the one of the ends of the rod means for marking a surface of a container to be marked on movement of the rod means relative to the handle means in the direction of a surface to be marked, wherein:

the handle means facilitates manipulation of the apparatus, and includes a hollow body defining a pair of opposed holes sized for slidably receiving the rod means; and the hollow body of the handle means comprises two hollow sections each in the shape of a conical frustum having a large base and a small base, the sections affixed to one another in overlying relation large base to large base, and each small base being provided with a respective one of the opposed holes defined in the hollow body.

2. Apparatus for marking a surface positioned in opposition to an access opening defined in a container, comprising, in combination:

(a) handle means for selectively engaging a portion of a container to be marked that surrounds an access opening defined in the container;

(b) elongated rod means having a pair of longitudinally spaced ends and mounted on the handle means for sliding movement relative thereto, the rod means having a one of the ends thereof arrangable extending through an access opening of and into a container to be marked when the handle means is selectively engaging a container to be marked; and (c) marker means mounted on the one of the ends of the rod means for marking a surface of a container to be marked on movement of the rod means relative to the handle means in the direction of a surface to be marked, said marker means including: block means mounted on the one of the ends of the rod means; imprint means mounted on the block means for selectively marking a surface to be marked; and resilient means for biasing the block means away from a surface to be marked, wherein:

the handle means facilitates manipulation of the apparatus, and includes a hollow body defining a pair of opposed holes sized for slidably receiving the rod means; and the hollow body of the handle means comprises two hollow sections each in the shape of a conical frustum having a large base and a small base, the sections affixed to one another in overlying relation large base to large base, and each small base being provided with a respective one of the opposed holes defined in the hollow body.

3. Apparatus as defined in claim 2, wherein a knob means is attached to the other of the ends of the rod means for facilitating sliding movement of the rod means relative to the handle means.

4. Apparatus as defined in claim 3, wherein the block means is provided with a blind bore extending into the block means and a through passageway communicating with and extending away from the blind bore, screw threads formed on the one of the ends of the rod means and complementary screw threads formed in the blind bore and arranged for permitting removable attachment of the block means to the rod means, the resilient means including a piston comprising a head portion slidably arranged in the bore and a shaft portion slidably arranged in the passageway and extending outside the block means, the resilient means further including a compression spring arrangable in the bore between the rod means and the head portion of the piston for biasing the piston away from the rod means.

5. Apparatus as defined in claim 4, wherein the imprint means includes stamp means mounted on the block means in spaced relation to the rod means and arranged for imprinting indicia on the surface of a container to be marked when the rod means is moved toward the surface to be imprinted against the bias of the resilient means.

6. In combination, an apparatus for marking a surface positioned in opposition to an access opening defined in a container and a holder for storing the apparatus, comprising:

(a) handle means for selectively engaging a portion of a container to be marked that surround an access opening defined in the container;

(b) elongated rod means having a pair of longitudinally spaced ends and mounted on the handle means for sliding movement relative thereto, the rod means having a one of the ends thereof arrangable extending through an access opening of and into a container to be marked when the handle means is selectively engaging a container to be marked;

(c) marker means mounted on the one of the ends of the rod means for marking a surface of a container to be marked on movement of the rod means relative to the handle means in the direction of a surface to be marked;

(d) a housing comprising a hollow, rectangular framework including an upwardly facing wall and a downwardly facing wall;

(e) socket means provided in the upwardly facing wall of the housing for selectively retainingly receiving a handle means of a marking apparatus to be held; and (f) inker means provided in the downwardly facing wall of the housing for inkingly engaging the marker means when the apparatus for marking is retainingly received in the socket means.

7. A combination as defined in claim 6, wherein the handle means includes a generally frustoconical-shaped section converging toward a respective one of the ends of the rod means, and the socket means including a frustoconical hollow shroud having a large base area forming an opening in the upwardly facing wall of the housing of the holder.

8. A combination as defined in claim 6, wherein the housing includes a port provided in the downwardly facing wall of the housing, and the inker means includes a cup-shaped receptacle arranged surrounding the port and against the downwardly facing wall of the housing on the outside thereof, and inked pad means disposed in the receptacle for engagement by the marker means when a marking apparatus is inserted into the holder.

9. A combination as defined in claim 8, wherein the handle means includes a generally frustoconical-shaped section converging to a respective one of the ends of the rod means, and the socket means including a frustoconical hollow shroud having a large base area forming an opening in the upwardly facing wall of the housing, the shroud terminating in a truncated apex extending downwardly through the port provided in the downwardly facing wall of the housing, and the receptacle being removably attached to and surrounding the small base of the shroud.

* * * * *